US007337692B2

(12) United States Patent
Willemsen et al.

(10) Patent No.: US 7,337,692 B2
(45) Date of Patent: Mar. 4, 2008

(54) ELECTRONIC THROTTLE CONTROL WITH HYSTERESIS DEVICE

(75) Inventors: Larry Willemsen, Morpeth (CA); Dan O'Neill, Chatham (CA); Peter Mischenko, Fingal (CA); Rob Sotenos, Lasalle (CA); Gregory Scott Kolwich, Ferndale, MI (US)

(73) Assignee: KSR Technologies Co., Ridgetown Ontario (CA)

( * ) Notice: Subject to any disclaimer, the term of this patent is extended or adjusted under 35 U.S.C. 154(b) by 0 days.

(21) Appl. No.: 11/565,117

(22) Filed: Nov. 30, 2006

(65) Prior Publication Data

US 2007/0137399 A1 Jun. 21, 2007

Related U.S. Application Data

(62) Division of application No. 10/621,904, filed on Jul. 17, 2003, now Pat. No. 7,216,563.

(60) Provisional application No. 60/413,504, filed on Sep. 25, 2002, provisional application No. 60/396,623, filed on Jul. 17, 2002.

(51) Int. Cl.
*G05G 1/14* (2006.01)

(52) U.S. Cl. ..... 74/512

(58) Field of Classification Search ..... 74/512, 74/513, 560, 518

See application file for complete search history.

(56) References Cited

U.S. PATENT DOCUMENTS 4,505,151 A * 3/1985 Sauerschell et al. ..... 73/116
5,385,068 A * 1/1995 White et al. ..... 74/512
5,416,295 A * 5/1995 White et al. ..... 200/86.5
6,220,222 B1 4/2001 Kalsi et al.
6,263,869 B1 7/2001 Abernethy et al.
6,305,240 B1 * 10/2001 Hannewald et al. ..... 74/513

(Continued)

FOREIGN PATENT DOCUMENTS

EP 0748713 12/1996

(Continued)

OTHER PUBLICATIONS

Pub-No.: EP 000 748 713 A2; Document Identifier EP 748 713 A2: Title: Accelerator pedal installation; Pub. date Dec. 18, 1996; and inventor: Helnrich Berglar. English Abstract.

*Primary Examiner*—Vicky A. Johnson
(74) *Attorney, Agent, or Firm*—Gifford, Krass, Sprinkle, Anderson & Citowski, P.C.

(57) ABSTRACT

An electronically controlled pedal assembly with hysteresis includes a mounting bracket and pedal arm and a pedal support arm extending therebetween. The pedal arm is pivotally mounted to the pedal support arm at a pedal arm pivot point. The pedal support arm is pivotally mounted to the mounting bracket at a pedal support arm pivot point. A hysteresis generating means is operatively supported by the support arm at the pedal support arm pivot point, and includes a torsion spring and a friction spacer having a cylindrical portion and an outer helical flange. The friction spacer is disposed within the torsion spring such that the outer flange of the friction spacer fits between the coils of the coil spring. Rotation of the support arm creates a frictional hysteresis force between the torsion spring and the friction spacer that is translated back through the pedal arm.

16 Claims, 5 Drawing Sheets

U.S. PATENT DOCUMENTS

| | | | | |
|---|---|---|---|---|
| 6,384,596 | B1 | 5/2002 | Beyer | |
| 6,384,597 | B1 | 5/2002 | Irle et al. | |
| 6,384,598 | B1 | 5/2002 | Hobein et al. | |
| 6,412,364 | B1 | 7/2002 | Berglar et al. | |
| 6,474,191 | B1 * | 11/2002 | Campbell | 74/514 |
| 6,718,845 | B2 * | 4/2004 | Menzies | 74/512 |
| 6,725,741 | B2 * | 4/2004 | Menzies | 74/514 |
| 6,860,170 | B2 * | 3/2005 | DeForest | 74/512 |

FOREIGN PATENT DOCUMENTS

| | | |
|---|---|---|
| GB | 2349447 | 11/2000 |
| JP | 2002114052 | 4/2002 |

* cited by examiner

ELECTRONIC THROTTLE CONTROL WITH HYSTERESIS DEVICE

CROSS-REFERENCE TO RELATED APPLICATIONS

This application is a divisional of U.S. patent application Ser. No. 10/621,904 filed Jul. 17, 2003 now U.S. Pat. No. 7,216,563, which claims priority of U.S. Provisional Patent Applications 60/396,623 filed Jul. 17, 2002, and 60/413,504 filed Sep. 25, 2002.

BACKGROUND OF THE INVENTION

1. Field of the Invention

The present invention relates generally to electronic controls for vehicles, and more particularly, to an electronically controlled pedal with a hysteresis device.

2. Description of the Related Art

Vehicles, and in particular automotive vehicles, utilize a foot-operated device, such as a brake pedal or a throttle control pedal, also referred to as an accelerator pedal, to control the movement of the vehicle. Conventional brake systems include a brake pedal for transmitting a braking force from the vehicle operator to the wheels of the vehicle. Similarly, conventional throttle control systems include a throttle pedal to transmit a signal from the vehicle operator to a controller to control acceleration and movement of the vehicle. Recent innovations in electronics technology have led to increased use of electronic controls for vehicle systems, such as the throttle system or the brake system.

In an electronically controlled throttle control system, the pedal arm is attached to a position sensor, which senses the relative position of the pedal arm and transmits a signal to a controller to operate the throttle. The electronically controlled brake system operates in a similar manner. However, since the pedal arm is not attached to a mechanical device, such as a rod or cable, there is no resistance to depression of the pedal, and the pedal returns to a nominal position quicker than with a mechanical system. This resistance is referred to as hysteresis. Hysteresis is advantageous because it provides the driver with a better "feel" of the pedal. Without a predetermined amount of hysteresis in the pedal, the driver may experience increased foot fatigue from the rapid adjustment of the pedal, especially when driving over a long period of time. In the past, a mechanical device was utilized to simulate the resistance to depression produced by a brake rod or a throttle cable in conventional pedal system, and return the pedal to its resting position. For example, European Patent No. EP 0748713 A2 discloses the use of a spring to return the pedal to its resting position. Another example of a mechanical device is a friction pad connected to an extension of the pedal arm to develop hysteresis during depression of the pedal. However, previously known hysteresis devices are complicated and utilize many parts.

At the same time, various position sensing devices are known in the art to sense the relative position of the accelerator pedal as the operator depresses or releases the accelerator pedal in controlling movement of the vehicle. One example of a position sensing device is a potentiometer. Another example of a position sensing device is an induction sensor. While these types of sensors work well, they are relatively expensive and may be difficult to package within the confined interior environment of the vehicle.

Thus, there is a need in the art for a hysteresis device for use with an electronically controlled pedal that has a minimal number of component parts and is cost-efficient to produce.

SUMMARY OF THE INVENTION

Accordingly, an electronically controlled pedal with a hysteresis device is provided. The pedal assembly includes a housing having a front wall and an arcuate friction wall having a radius of curvature centered on a pedal arm pivot point and extending from an edge of the front wall. The pedal assembly also includes a pedal arm rotatably supported at the pedal arm pivot point by a mounting means operatively connected to the housing, and a hysteresis generating means pivotally mounted to the pedal arm. The pedal assembly further includes a spring positioned between the housing and the hysteresis generating means, such that the spring biases the hysteresis generating means against the housing, so that depression of the pedal arm compresses the spring while generating an increasing frictional hysteresis force between the arcuate friction wall and the hysteresis generating means that is translated back through the pedal arm, and release of the pedal arm reduces the frictional hysteresis force.

One advantage of the present invention is that an electronically controlled pedal assembly is provided that includes a hysteresis device to simulate the resistance to depression of the pedal. Another advantage of the present invention is that the hysteresis device for the electronically controlled pedal is simpler in design than previous designs, to enhance packageability within the interior environment of the vehicle. Still another advantage of the present invention is that the hysteresis device is cost-effective to manufacture. A further advantage of the present invention is that an electronically controlled pedal assembly is provided that utilizes an induction sensor Lo sense a change in position of the pedal arm that is small in size and can be efficiently packaged in a pedal control with a hysteresis device. Still a further advantage of the present invention is that the induction sensor is contained within a cap mounted to the housing of the electronically controlled pedal assembly.

Other features and advantages of the present invention will be readily appreciated, as the same becomes better understood after reading the subsequent description taken in conjunction with the accompanying drawings.

BRIEF DESCRIPTION OF THE DRAWING

FIG. 7 is a side view of the hysteresis device for the pedal assembly of FIG. 6, according to the present invention;

FIG. 8 is a side view of the friction spacer of FIG. 7, according to the present invention;

FIG. 9 is a sectional front view of the pedal assembly of FIG. 6, according to the present invention;

DETAILED DESCRIPTION OF THE PREFERRED EMBODIMENTS

Figure 1:
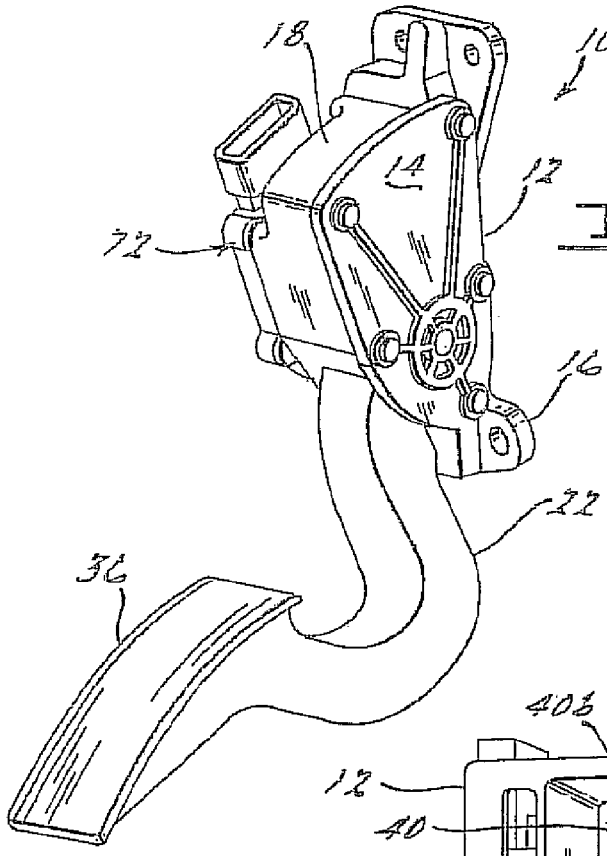
FIG. 1 is a perspective view of an electronically controlled pedal assembly, according to the present invention.
Figure 2:
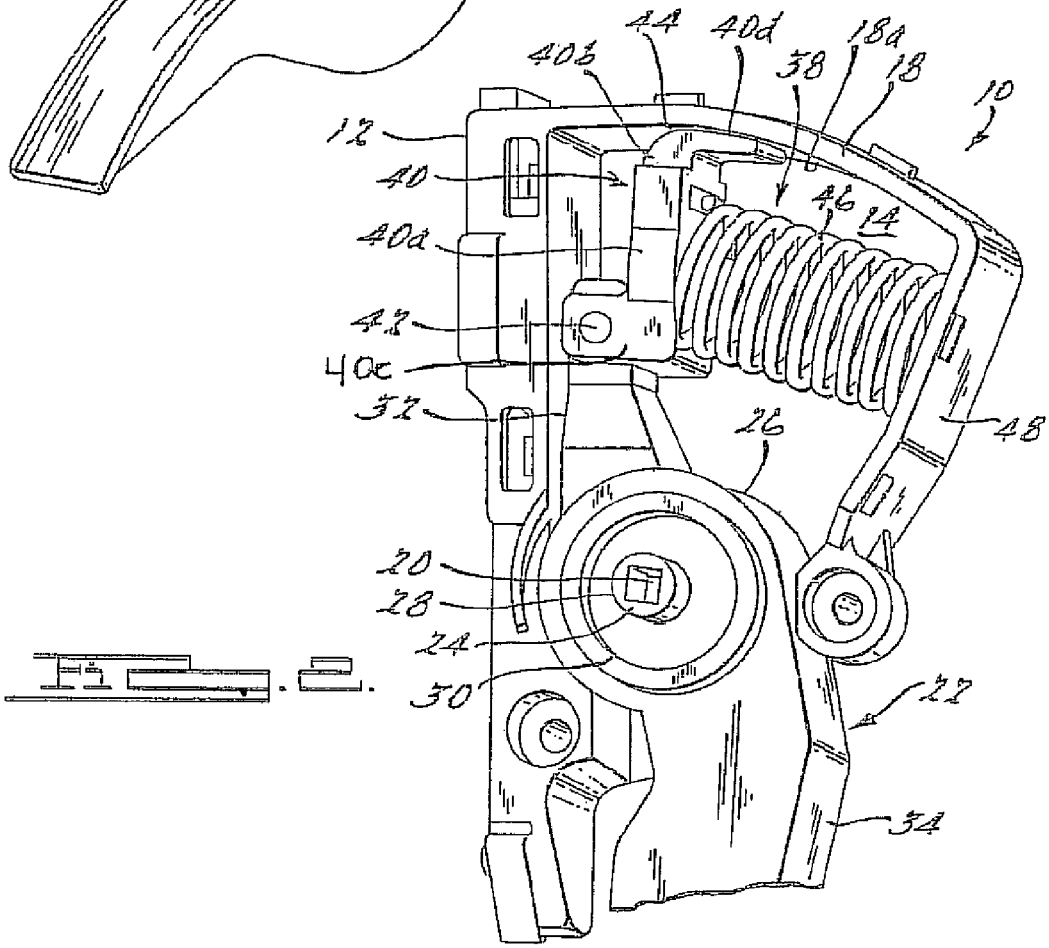
FIG. 2 is a side view of the pedal assembly of FIG. 1 with one example of a hysteresis device, according to the present invention.

Referring to FIGS. 1 and 2, an electronically controlled pedal assembly is illustrated. It should be appreciated that in this example the electronically controlled pedal is a throttle pedal, although other types of pedals are contemplated, such as brake pedal, a clutch pedal, or the like.

The electronic throttle control pedal assembly 10 of this example transmits a signal from the driver to a throttle controller (not shown) regarding movement of the vehicle. The pedal assembly 10 includes a housing 12 having a front wall 14 with tabs 16 for mounting the pedal assembly 10 to a vehicle (not shown). Extending from an edge of the front wall 14 at the top of the housing is friction wall 18 having an arcuate shape and a radius of curvature centered at a pedal arm pivot point 20. The pedal assembly 10 includes a pedal arm 22 rotatably supported by a mounting means shown at 24. The mounting means 24 rotatably supports the pedal arm 22, so that the pedal arm 22 rotates about the pedal arm pivot point 20. Various examples of mounting means 24 are contemplated. One example of a mounting means is a pivot pin. Another example of a mounting means is a hub on each side of the pedal arm. Still another example of a mounting means is a hub and post arrangement (to be described).

The pedal arm 22 includes a disk portion 26 at a pedal arm pivot point that extends outwardly in an axial direction. The disk portion 26 includes a mounting means 24 for the pedal arm 22. Various types of mounting means 24 are contemplated. For example, the mounting means 24 may be a pivot pin mounted to the housing and supporting the pedal arm. Alternatively, the mounting means may include a post 31 extending radially from one side of the disc portion 26 at a pedal arm pivot point 20. The post 31 includes a longitudinally extending bore 28 extending partially therethrough for receiving a position sensing device 70. The post 31 is supported by the housing. The opposite side of the pedal arm disk portion 26 includes a longitudinally extending bore (not shown) for receiving another post 33 integrally formed in the housing. The mounting means may include a bushing 30.

The pedal arm 22 extends through an opening in the housing 12. The pedal arm 22 includes an upper pedal arm 32 extending radially from an edge of the disc portion 26 towards the friction wall 18. The pedal arm 22 also includes a lower pedal arm 34 extending radially from the edge of the disc portion 26. A pedal pad 36 that is actuated by a driver's foot (not shown) is attached to a distal end of the lower pedal arm 34 using an attaching means, such as a pivot pin or the like.

The electronically controlled pedal assembly 10 further includes a hysteresis generating device 38. The upper pedal arm is operatively in communication with the hysteresis device 38. In this example, the hysteresis device includes a friction lever 40 pivotally mounted to a distal end of the upper pedal arm 32 at a friction lever pivot point shown at 42. The friction lever 40 includes an integrally formed main member 40*a*, an upper member 40*b* extending radially from an upper edge of the main member 40*a* and a lower member 40*c* extending radially from a lower edge of the main member 40*a*. The distal end of the lower member 40*c* is pivotally connected to the upper pedal arm 32 at the friction lever pivot point 42. The upper member 40*b* has an arcuate shape that is complementary with the shape of the inner surface of the housing friction wall 18. In this example, the outer surface 40*d* of the upper member 40*b* is abraded like a brake shoe to frictionally engage the corresponding arcuate surface of the friction wall 18. The friction lever 40 generally has an "S" shape, and is integral and formed as one piece.

The friction lever 40 is biased against the housing 12 as shown at 44 by a spring member 46. In this example, the spring 46, is a compression spring, and is positioned between the friction lever 40, and in particular the main portion of the friction lever 40 and a rear wall 48 of the housing 12. There may be two springs 46 in parallel with each other. Preferably, the spring 46 is fixedly mounted to the housing 48 and friction lever 40 so that it extends between the housing 12 and the friction lever 40 to generate greater friction.

In this example, as the pedal arm 22 is depressed, the disk portion 26 of the pedal arm 22 rotates and the spring 46 is compressed between the friction lever 44 and rear wall 48 of the housing 12. The force of the spring 46 works in opposition to the force of the arm to pivot the friction lever 40 slightly. The arcuate portion 40*d* of the friction lever 40 is canted slightly with respect to the arcuate surface 18*a* of the friction wall 18 like a cam to generate friction. When the pressure on the pedal arm 22 is released to permit the pedal arm 22 to return towards rest, the spring pressure on the rear wall of the friction lever 18 pivots the upper portion 40*b* into coaxial alignment with the friction lever arcuate surface 18*a* thereby reducing the friction between the friction surface 40*d* of the upper portion 40*b* and friction wall 18 and permitting return of the pedal arm 22 to a resting position.

The electronically controlled pedal assembly 10 further includes a position sensing device 70 operatively supported by the mounting means 24 at the pedal arm pivot point 24. The sensing device 70 is used to sense the rotational movement of the pedal arm 22, which is indicative of the relative pedal position, and transmit a signal to a control means (not shown) to operatively control a throttle controller (not shown) and thus the movement of the vehicle. Preferably the signal is a proportional voltage signal. It should be appreciated that the electronically controlled pedal assembly 10 may include a blade (not shown) operatively connected to the sensing device 70 to generate a signal indicative of the position of the pedal arm 22 during operation.

Various types of position sensing devices are known in the art to sense rotational movement. One example of such a sensing device is a potentiometer. Another example of a sensing device is an induction sensor. The induction sensor utilizes inductance changes in a transducer circuit to produce an output signal representing the change in position of the pedal arm 22. Advantageously, the induction sensor works well in harsh environments or in environments subject to fluctuations in temperature. One example of an induction sensor utilizes a linear or a rotary variable differential transformer means, or a Hall effect detection of magnetic change, to convert a displacement or angular measurement to an electronic or electromagnetic signal. While these types of sensors work well, they require complex electronic circuitry to transduce a signal, and are expensive to manufacture.

Another example of an induction sensor is disclosed in U.S. Pat. No. 6,384,596, the disclosure of which is incorporated herein by reference. This type of induction sensor utilizes a comparator-type relaxation oscillator circuit having a frequency controlled by variable inductance. Each oscillation of the circuit discharges a fixed amount of charge such that an increase in frequency increases the total current draw of the circuit. An advantage of this induction sensor is that it includes a simplified circuit, so that it is simpler in design and may be reliably manufactured at a lower cost, and a smaller size. Another advantage of this type of induction sensor is greater calibration accuracy since both electrical and mechanical trim may be implemented to calibrate the transducer output signal.

Figure 10:
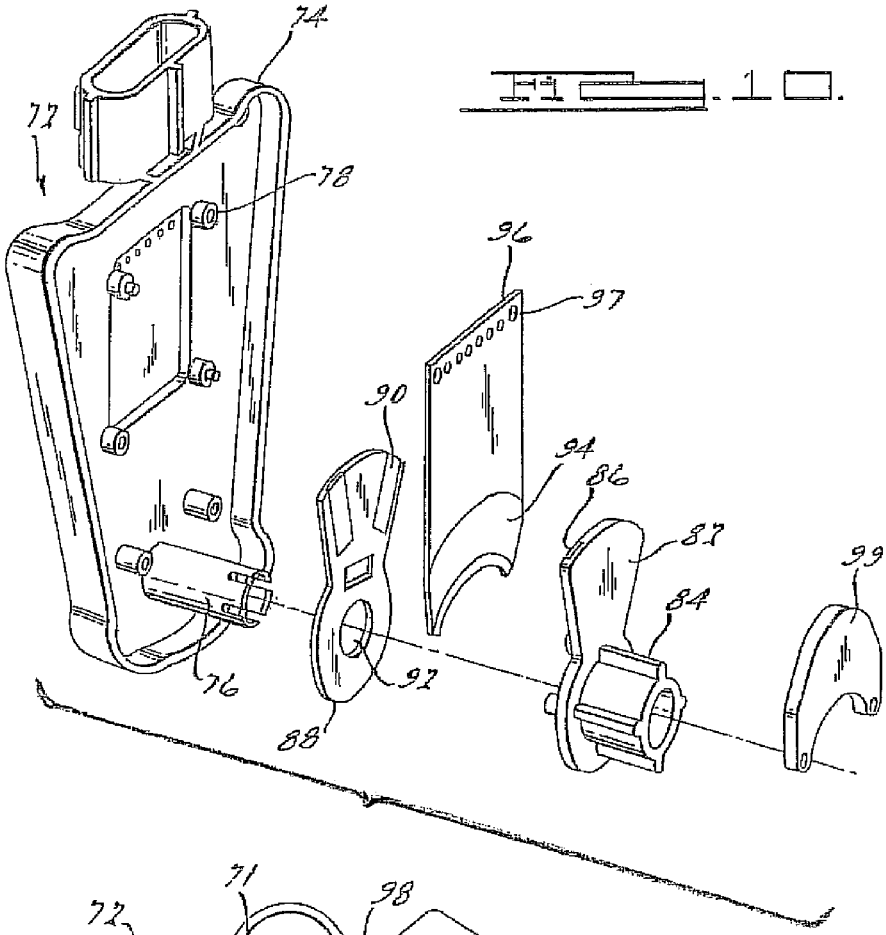
FIG. 10 is an exploded view of the cap assembly with induction sensor, according to the present invention.
Figure 11:
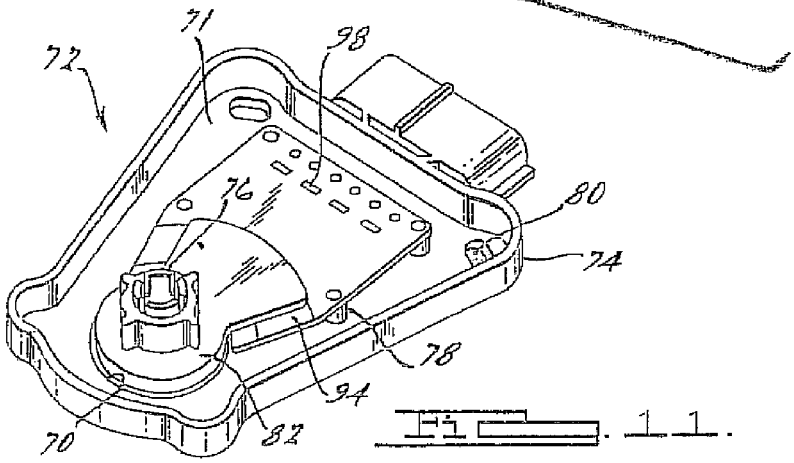
FIG. 11 is a perspective view a cap assembly having an induction sensor for the pedal assembly of FIG. 1, according to the present invention.

Referring to FIGS. 10-11, an example of cap assembly 72 with an induction sensor 70 mounted to it is illustrated for use with an electrically controlled pedal assembly having a hysteresis device. The cap assembly 72 includes a cap 74 configured to mate with the housing 12. The cap includes a front face 71 having a radially extending alignment post 76 for operatively aligning the cap assembly 72 onto the mounting means 24 at the pedal arm pivot point 20. The alignment post 76 is supported on a post by the mounting means, which in this example is a hub and post 31 arrangement.

The cap 74 also includes a plurality of radially extending mounting posts 78 arranged in a predetermined pattern for mounting the induction sensor 70 thereto. The cap 74 further includes at least one elongated slot 80 for fixedly securing the cap assembly 72 to the housing 12, such as by using a bolt, or the like. Advantageously, the relative size and location of the slots 80 with respect to the alignment post 76 allow the cap assembly 72, and therefore the induction sensor 70, to be positioned relative to the housing 12. Thus, by slightly rotating the cap assembly 72 with respect to the housing 12, the span of the induction sensor 70 with respect to the pedal arm 22 may be established. In this example, the slot 80 allows for about 1½ degrees of rotation of the cap assembly 72.

The induction sensor 70 includes a pair of rotors, with a stator suspended between the rotors. The first rotor 82 is a generally planar member with radially extending center post 84 that is hollow, and conductive plates 86 positioned on the planar member above the center post 84. It should be appreciated that the shape of the first rotor center post 84 corresponds to the shape of the aperture 28 in the pedal arm 22. The second rotor 88 is a generally planar member, with conductive plates 90 positioned on the second rotor 88 relative to the conductive plates 86 of the first rotor 82, and positioned above a center mounting aperture 92. The stator 94 is mounted onto a generally planar circuit board 96. It should be appreciated that the previously described comparator-type relaxation oscillator circuit having a frequency controlled by variable inductance is disposed on the printed circuit board as shown at 98. The circuit board includes mounting apertures 97 arranged in a predetermined manner to correspond with the mounting posts 78 on the cap 74, for mounting the circuit board 96 onto the cap 74. To assemble the case assembly 72, the second rotor 88 slides over the post 76, the circuit board 96 is mounted onto the mounting posts 78 of the cap 74, and the post 84 of the first rotor 82 is positioned over the alignment post 76 of the cap 74.

In this manner, the stator 94 is suspended between the first and second rotors 82, 88, above the post 84 of the first rotor 82. It should be appreciated that the cap assembly 72 may include a crossbar member 99, which in this example, is a generally planar member having a u-shape, that is suspended over the first rotor post 84 and assists in holding the cap assembly 72 together and absorbing any lateral load. The alignment post 76 of the cap 74 is positioned on the mounting means 24, thereby fixing the position of the rotor 82, 88 relative to the pedal arm 22, while rotatable relative to the pedal arm 22.

In operation, as the driver actuates the pedal pad 34 and thus the pedal arm 22, the pedal arm 22 pivots about the pedal arm pivot point 20. The induction sensor 70 senses the angular movement of the pedal arm 22 about the pedal arm pivot point 20, and transmits a proportional signal, such as a voltage signal, to a controller. The controller analyzes the signal, and transmits a signal to the throttle controller instructing the throttle controller to actuate the throttle accordingly.

Figure 3:
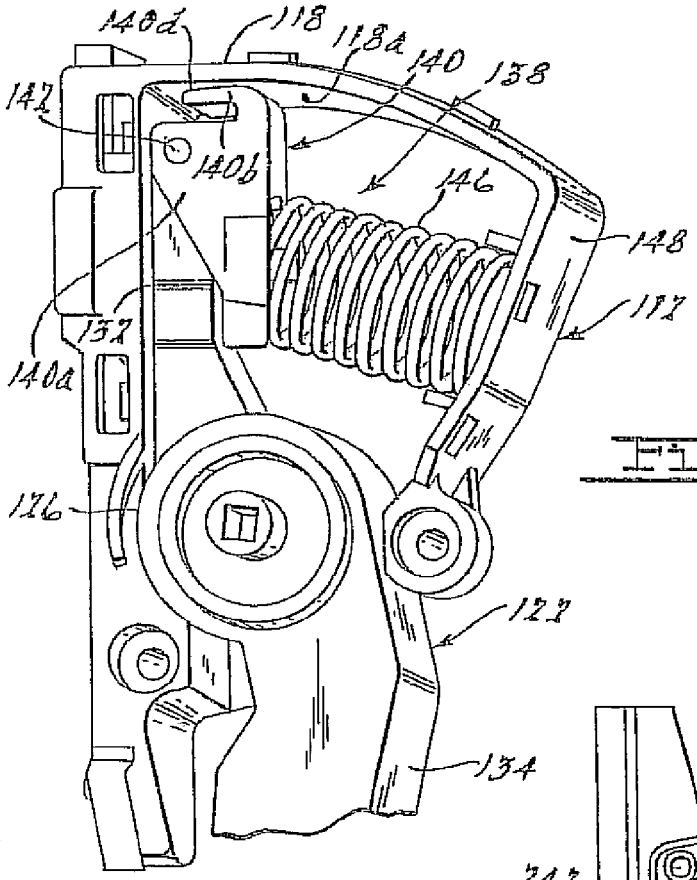
FIG. 3 is a side view of the pedal assembly of FIG. 1 with another embodiment of a hysteresis device, according to the present invention.

Referring to FIG. 3, another embodiment of an electronic throttle control pedal assembly 110 with a hysteresis device 138 is illustrated. It should be appreciated that like components have like reference numbers increased by 100 to the embodiment in FIG. 1. In this example, the pedal arm 122 includes an upper pedal arm 132 extending radially from the pedal arm disk 126 towards the friction wall 118. It should be appreciated that the upper pedal arm 132 in this embodiment is longer than the upper pedal arm 32 in the previous embodiment. A friction lever 140 is pivotally mounted to a distal end of the upper pedal arm 132 at a friction lever pivot point as shown at 142. The friction lever 140 has a main member **140*a*, and an upper member 140*b* extending forwardly from the main portion 140*a* of the friction lever 140. The upper member 140*b* is arcuate in shape and has a surface 140*d* complementary with an inner arcuate surface 118*a* of the friction wall 118. In this example, the upper member arcuate surface 140*d* is abraded like a brake shoe to frictionally engage the friction wall 118*a***, which may also be abraded.

The pedal assembly 110 further includes a spring member 146, such as a compression spring, positioned between the main portion **140*a* of the friction lever 140 and a rear wall 148 of the housing 112. It should be appreciated that a rear surface of the friction lever is adapted to receive a spring, as well as the rear wall 148**. In this example, there are two springs in parallel, that is, an inner spring and an outer spring. The inner and outer spring are used to create load in the system and hysteresis. Advantageously, if one of the springs fails, the other is still operational.

In this example, as the pedal arm 122 is depressed, the disk portion 26 of the pedal arm rotates and the spring 146 is compressed between the friction lever 140 and rear wall 148 of the housing 112. The force of the spring 146 works in opposition to the force of the pedal arm 112 to pivot the friction lever 140 slightly. The arcuate portion **140*d* of the friction lever 140 is canted slightly with respect to the arcuate surface 118 of the friction wall 118*a* like a cam to generate friction. When the pressure on the pedal arm 122 is released to permit the pedal arm 122 to return towards rest the spring pressure on the rear wall of the friction lever 140*a* pivots the upper portion 140*b* into coaxial alignment with the friction wall 118 thereby reducing the friction between the frictional surface of the upper portion 140*b* and friction wall 118 and permitting return of the pedal arm 122 to a resting position. In this embodiment, the hysteresis is developed at a greater rate than in the previously described embodiment, since the pedal arm 122 travels through a greater arc with respect to the friction lever 140. As a result, there is greater interference between the frictional surfaces of the friction lever 140 and the inner surface of the friction wall 118**.

Figure 4:
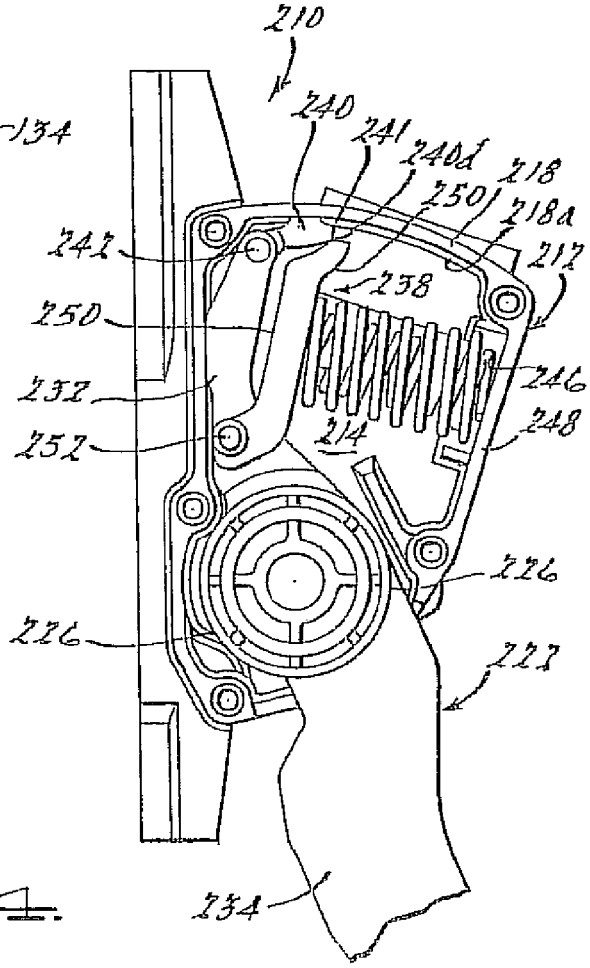
FIG. 4 is a side view of the pedal assembly of FIG. 1 with still another embodiment of a hysteresis device, according to the present invention.

Referring to FIG. 4 still another embodiment of an electronic throttle control pedal assembly 210 with a hysteresis device 238 is illustrated. It should be appreciated that like components have like reference numbers increased by 200 with respect to the embodiment in FIG. 1. It should also be appreciated that this pedal assembly 210 is similar to the previously described embodiments. The pedal arm 222 includes an upper pedal arm 232 extending radially from a pedal arm disk 226, and a lower pedal arm 234 also extending radially from the pedal arm disk 226. The upper pedal arm 232, pedal arm disc 226 and lower pedal arm 234 are integral and formed as one.

The pedal assembly 210 includes a housing having a front wall 214, a friction wall 218 having an abraded surface 218*a*, and a rear wall 248. The friction wall 218 may have an arcuate shape and a radius of curvature centered at a pedal arm pivot point 220.

The hysteresis device 238 includes a friction lever 240 that is pivotally mounted to the upper pedal arm 232 at a friction lever pivot point 242. The friction lever 240 extends from an outer portion of the upper pedal arm 232 and curves rearwardly towards the rear wall 248 of the housing 212. The friction lever 240 includes an abraded surface 240*d*, as previously described. This embodiment is distinguishable since the friction lever is biased against the friction wall 218 by a push arm 250 and a spring 246.

The hysteresis device 238 also includes a push arm 250 pivotally mounted to the upper pedal arm 232 at a push lever pivot point 252 that is radially inwards from the friction lever pivot point 242. The push lever arm 250 curves upwardly and rearwardly towards the friction wall 218, so as to contact an under side of the friction lever 240 at a predetermined contact point, as shown at 241. It should be appreciated that the contact point 241 is selected by the amount of frictional force desired. That is, increasing the distance between the contact point 241 and the friction lever pivot point 242 increases the amount of friction generated by the hysteresis device 238. The system 210 also includes a spring 246 mounted between the rear wall 248 of the housing 212 and the push arm 250. The spring 246 forces the push arm 250 against the friction lever 240 to generate greater friction, as previously described.

Figure 5:
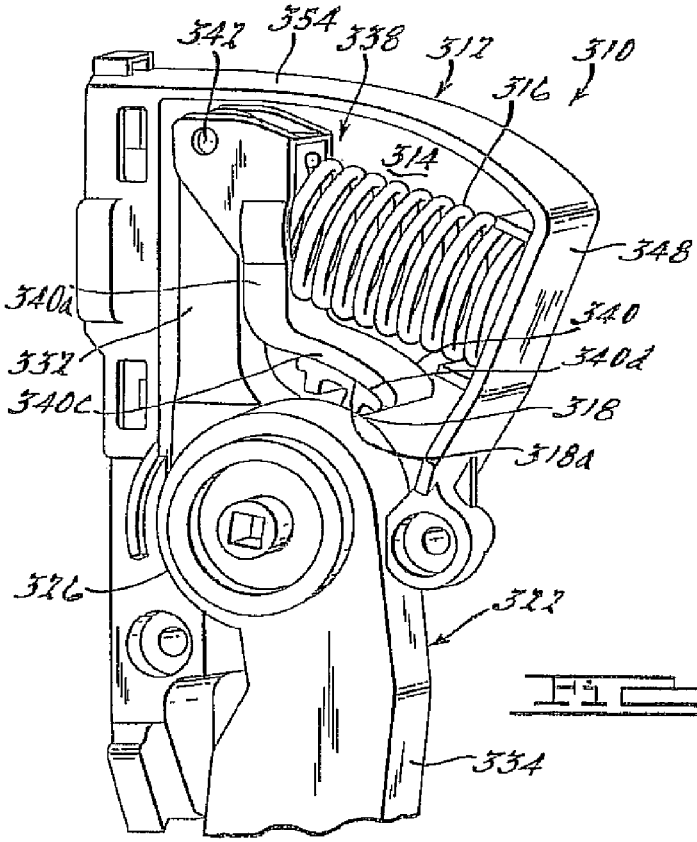
FIG. 5 is a side view of the pedal assembly of FIG. 1 with yet still another embodiment of a hysteresis device, according to the present invention.

Referring to FIG. 5, still another embodiment of an electronic throttle pedal assembly 310 with a hysteresis device 338 is illustrated. It should be appreciated that like components have like reference numbers increased by 300 with respect to the embodiment in FIG. 1. It should also be appreciated that the pedal assembly 310 is similar to the previously described embodiments. The pedal arm 322 includes an upper pedal arm 332 extending radially from a pedal arm disk 326. The pedal assembly 310 includes a housing 312 having a front wall 314, a friction wall 318, an upper wall 354 and a rear wall 348. The friction wall 318 extends radially from the front wall of the housing 312. The friction wall 318 is arcuate in shape and includes an arcuate friction surface 318*a*. The friction wall 318 is spaced radially outwardly from the pedal arm disk 326, but inwardly from the end of the upper pedal arm 332.

The hysteresis device 338 includes a friction lever 340 having a main portion 340*a* pivotally mounted to the upper pedal arm 332 at a friction lever pivot point 342, and a lower portion 340*c* that angles inwardly and rearwardly from the upper pedal arm 332. The lower portion 340*c* includes an arcuate friction surface 340*d*. The arcuate friction surface 340*d* is complementary to the frictional surface 318*a* of the friction wall 318.

The pedal assembly 310 further includes a spring 346 extending between the rear wall of the housing 312 and the main portion 340*a* of the friction lever 340, as previously described with respect to FIG. 1. In this embodiment, the spring 346 is positioned beneath the friction lever pivot point 342 of the friction lever 340, so that the resultant force acting on the friction lever 340 directs the friction lever 340 downwardly against the friction surface 318*a* of the friction wall 318.

In operation, rotation of the pedal arm 322 compresses the spring 346 while the friction lever 342 moves along the friction wall 318, to create the frictional hysteresis force in the pedal assembly 310. It should be appreciated that in this example there may be two springs, an inner spring and an outer spring, as previously described.

Figure 6:
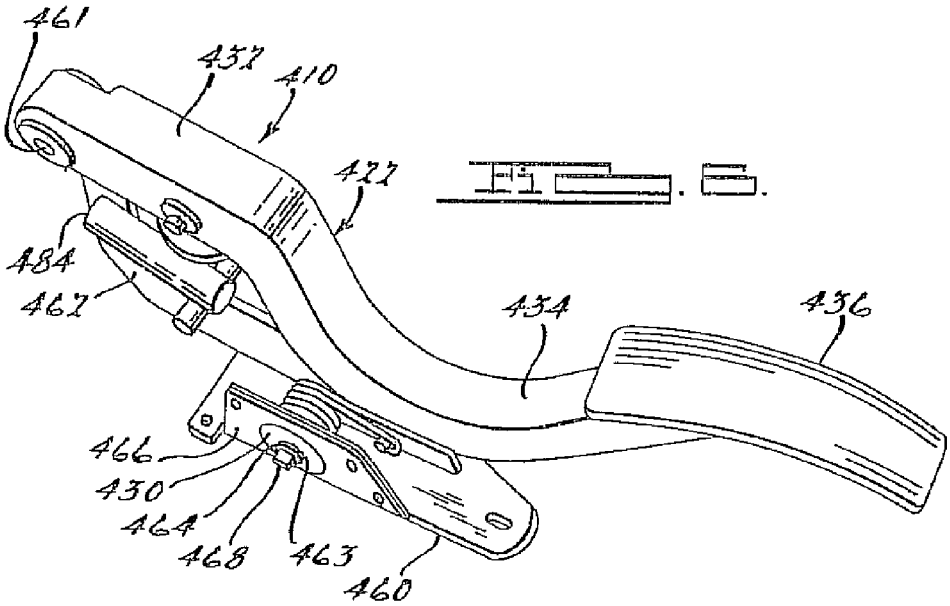
FIG. 6 is a perspective view of a further embodiment of an electronically controlled pedal assembly with a hysteresis device, according to the present invention.
Figure 3:
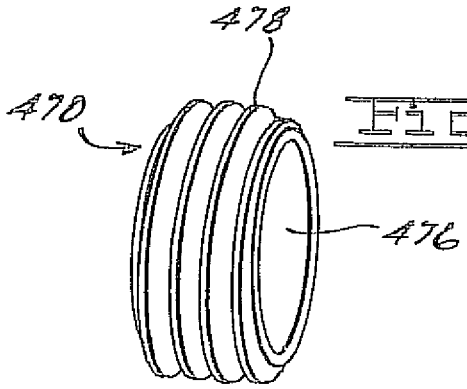
Figure 4:
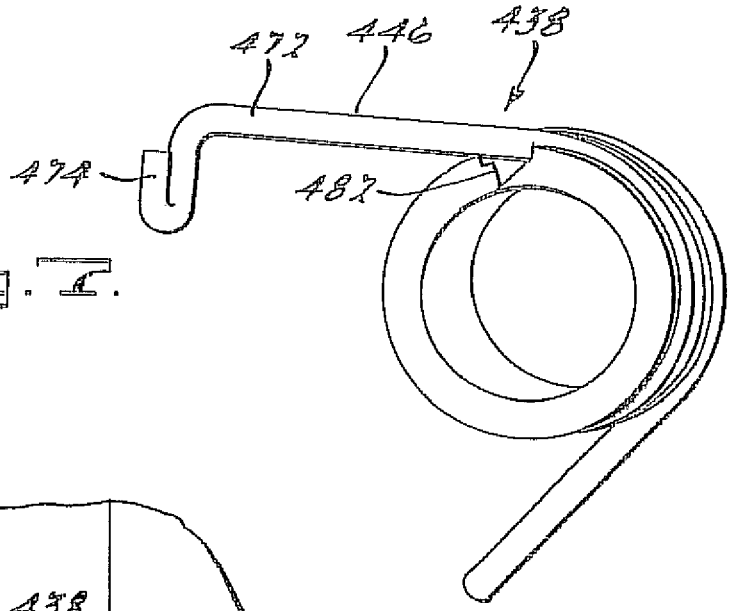
Figure 5:
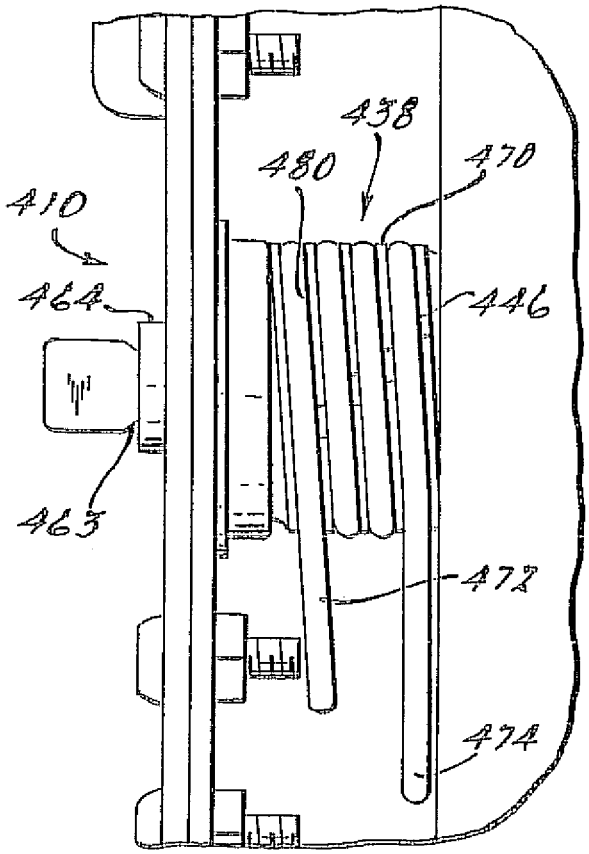

Referring to FIGS. 6-9, a further embodiment of an electronic pedal assembly 410 with a hysteresis device is illustrated. In this embodiment, the adjustable pedal assembly 410 is pivotally mounted to a support bracket 460. The pedal assembly 410 has a support arm 462 which extends between the bracket 460 and a pedal arm 422. The pedal arm 422 is pivotally mounted to the support arm at a pedal arm pivot point 461. The support arm 462 is pivotally mounted to the bracket 460 at the support arm pivot point 463 using a mounting means. For example a pivot rod 464 extends between two flanges 466 of the bracket 460 to support the support arm 462, as shown in FIG. 6. The mounting means may also include a bushing to support the pivot rod 464. One end of the rod 464 has a tab 468 extending out beyond one side of a flange 466 to engage a position sensing device, as previously described with respect to FIG. 1. An example of a pedal assembly with a support arm is disclosed in commonly assigned U.S. patent application Ser. No. 10/080,006 which is incorporated herein in its entirety.

The hysteresis device 438 includes a coil spring 446 and friction spacer 470, as shown in FIGS. 7-9. The coil spring 446 is mounted onto the pivot rod 464 at the support arm pivot point 463. In this example, the spring 446 is a torsion spring. The coil spring 446 has two arms 472. A hook 474 is formed in an end of one arm 472 for attachment to the support arm 462. The other arm rests against the inner wall of the bracket 460.

The friction spacer 470 includes a cylindrical member 476 having an outer helical flange 478. Preferably, the flange 478 has a thickness greater than the spacing between the coils of the spring, when the spring is in a resting position. As shown in FIG. 9, the friction spacer 470 is mounted between the coils of the coil spring 446, so that the flange 478 extends into the helical space between each coil of the spring 446, as shown at 480. Preferably, the friction spacer is cut radially as shown at 482, so that it can be compressed together for ease of insertion into the coils of the spring 446. Once in position, the friction spacer 470 is allowed to expand so that the helical flange 478 fills the spacing 480 between the coils of the spring 446. Preferably, the friction spacer 470 is made of a moldable material such as polyester.

In operation, as the pedal arm 422 is depressed, the support arm 462 pushes against the arm of the coil spring 446 to tighten the coil portion. As the coils tighten, the individual coils move inwardly, creating a torsional force which acts upon the flange of the friction spacer 470 thereby developing hysteresis in the pedal arm 422.

It should be appreciated that the pedal assembly may include various combinations of the hysteresis and position sensing means previously described. For example, the pedal assembly 10 may include the hysteresis devices described with respect to any one of FIGS. 1-9 and an induction position sensing means, such as a potentiometer. In a further example, the pedal assembly includes any one of the hysteresis devices described with respect to FIGS. 1-9 and an induction position sensing means, such as one described with respect to FIGS. 10-11. It should also be appreciated that the pedal assembly may include other components that are known in the art, such as an adjustable pedal height mechanism 484 or electrical connectors, or the like.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

The invention claimed is:

1. An electronically controlled pedal assembly with hysteresis comprising:

a mounting bracket;

a pedal arm;

a pedal support arm extending between said bracket and said pedal arm, wherein said pedal arm is pivotally mounted to said pedal support arm at a pedal arm pivot point using a pedal arm mounting means, and said pedal support arm is pivotally mounted to said mounting bracket at a pedal support arm pivot point using a support arm mounting means;

a hysteresis generating means having a torsion spring and a friction spacer each operatively supported on said support arm mounting means and pivotable about said pedal support arm pivot point, wherein said torsion spring has a coil, and said friction spacer has a cylindrical portion and an outer helical flange that is interposed with said torsion spring coil, so that rotation of said support arm creates a frictional hysteresis force between said torsion spring coil and said friction spacer helical flange that is translated back through said pedal arm.

2. The pedal assembly of claim 1 wherein said friction spacer includes a radially oriented slit for interposing said friction spacer with said torsion spring coil.

3. The pedal assembly of claim 2 wherein said mounting means is a pivot pin.

4. The pedal assembly of claim 1 wherein torsion spring includes two arms, with one arm having a hook formed in an outer end of the arm, and the hooked end is attached to said support arm.

5. The pedal assembly of claim 1 wherein a thickness of the friction spacer helical flange is greater than a distance between adjacent torsion spring coils when said torsion spring is in a resting position.

6. The pedal assembly of claim 1 wherein said friction spacer is made from a polyester material.

7. An electronically controlled pedal assembly with hysteresis comprising:

a mounting bracket;

a pedal arm;

a pedal support arm extending between said bracket and said pedal arm, wherein said pedal arm is pivotally mounted to said pedal support arm at a pedal arm pivot point using a pedal arm mounting means, and said pedal support arm is pivotally mounted to said mounting bracket at a pedal support arm pivot point using a support arm mounting means;

a hysteresis generating means having a torsion spring and a friction spacer each operatively supported on said support arm mounting means at said pedal support arm pivot point wherein said torsion spring has a coil with two arms, and said friction spacer has a cylindrical portion and an outer helical flange that is interposed between said torsion spring coil, and a thickness of the friction spacer helical flange is greater than a distance between adjacent torsion spring coils when the torsion spring is in a resting position, so that rotation of said support arm creates a frictional hysteresis force between said torsion spring coils and said friction spacer helical flange that is translated back through said pedal arm.

8. The pedal assembly of claim 7 wherein said friction spacer includes a radially oriented slit for interposing said friction spacer with the torsion spring coils.

9. The pedal assembly of claim 7 wherein said mounting means is a pivot pin.

10. The pedal assembly of claim 7 wherein one torsion spring arm has a hook formed in an outer end of the arm, and the hooked end is attached to said support arm.

11. The pedal assembly of claim 7 wherein said friction spacer is made from a polyester material.

12. An electronically controlled pedal assembly with hysteresis comprising:

a mounting bracket;

a pedal arm pivotally supported by said mounting bracket using a pivot pin;

a torsion spring rotatably mounted on said pivot pin, wherein the torsion spring includes a coil with a first arm and a second arm;

a friction spacer rotatably supported on said pivot pin, wherein the friction spacer includes a cylindrical portion and an outer helical flange encircling the cylindrical portion and the outer helical flange is interposed with the torsion spring coil, so that rotation of said pedal arm creates a frictional hysteresis force between the torsion spring coil and the friction spacer helical flange that is translated back through said pedal arm.

13. The pedal assembly of claim 12 wherein said friction spacer includes a radially oriented slit for interposing said friction spacer with said torsion spring coil.

14. The pedal assembly of claim 12 wherein torsion spring first arm includes a hook formed in an outer end of the torsion spring first arm, and the hooked end is attached to the pedal arm.

15. The pedal assembly of claim 12 wherein a thickness of the friction spacer helical flange is greater than a distance between adjacent torsion spring coils when said torsion spring is in a resting position.

16. The pedal assembly of claim 12 wherein said friction spacer is made from a polyester material.

* * * * *

UNITED STATES PATENT AND TRADEMARK OFFICE

CERTIFICATE OF CORRECTION

PATENT NO. : 7,337,692 B2
APPLICATION NO. : 11/565117
DATED : March 4, 2008
INVENTOR(S) : Larry Willemsen et al.

It is certified that error appears in the above-identified patent and that said Letters Patent is hereby corrected as shown below:

Column 2, line 37, replace “sensor Lo sense” with --sensor to sense--

Column 3, line 64, replace “pedal arm” with --pedalarm 32--

Signed and Sealed this

First Day of July, 2008

JON W. DUDAS
*Director of the United States Patent and Trademark Office*